US012590765B2

(12) United States Patent
Thumm

(10) Patent No.: US 12,590,765 B2
(45) Date of Patent: Mar. 31, 2026

(54) HEAT EXCHANGER DIMPLE CONFIGURATION

(71) Applicant: Modine Manufacturing Company, Racine, WI (US)

(72) Inventor: Sven Michael Thumm, Metzingen (DE)

(73) Assignee: Modine Manufacturing Company, Racine, WI (US)

( * ) Notice: Subject to any disclaimer, the term of this patent is extended or adjusted under 35 U.S.C. 154(b) by 101 days.

(21) Appl. No.: 18/799,086

(22) Filed: Aug. 9, 2024

(65) Prior Publication Data

US 2025/0052510 A1 Feb. 13, 2025

(30) Foreign Application Priority Data

Aug. 11, 2023 (EP) ..... 23191133

(51) Int. Cl.
*F28D 9/00* (2006.01)
*F28F 13/12* (2006.01)

(52) U.S. Cl.
CPC ..... *F28D 9/0075* (2013.01); *F28F 13/12* (2013.01)

(58) Field of Classification Search
CPC ..... F28D 9/0075; F28D 9/005; F28D 9/0037; F28F 13/12; F28F 3/086; F28F 3/08; F28F 3/042; F28F 3/044; F28F 3/025
(Continued)

(56) References Cited

U.S. PATENT DOCUMENTS 4,696,342 A * 9/1987 Yamauchi ..... F28D 1/0341 165/906
4,781,248 A * 11/1988 Pfeiffer ..... F28F 3/083 165/166

(Continued)

FOREIGN PATENT DOCUMENTS

CA 2298118 A1 8/2000
DE 19519312 A1 11/1996

(Continued)

OTHER PUBLICATIONS

European Patent Office Search Report and Written Opinion for Application No. 23191133 dated Feb. 13, 2024 (7 pages).

(Continued)

*Primary Examiner* — Jon T. Schermerhorn, Jr.
(74) *Attorney, Agent, or Firm* — Michael Best & Friedrich LLP

(57) ABSTRACT

An oil cooler has alternating first and second heat exchanger plates coupled to a base heat exchanger plate. The first heat exchanger plate includes upstanding impressions extending upwardly a first distance from a generally planar surface away from the base heat exchanger plate. The second heat exchanger plate includes descending impressions extending downwardly a second distance from the second generally planar surface toward the base heat exchanger plate. Planar portions of the first and second plates are spaced apart a third distance. The first distance and the second distance are each less than the third distance. The upstanding impressions extend along a first length, and the descending impressions extend along a second length. A third length of each upstanding impression abuts a fourth length of the respective descending impression. The third length is less than the first length and the fourth length is less than the second length.

20 Claims, 9 Drawing Sheets

(58) Field of Classification Search
USPC ..... 165/109.1
See application file for complete search history.

(56) References Cited

U.S. PATENT DOCUMENTS

| | | | | |
|---|---|---|---|---|
| 4,815,532 | A | 3/1989 | Sasaki et al. | |
| 6,047,769 | A * | 4/2000 | Shimoya | F28F 3/048 165/176 |
| 6,209,629 | B1 | 4/2001 | Halt et al. | |
| 6,318,456 | B1 * | 11/2001 | Brenner | F28D 9/005 165/DIG. 373 |
| 6,378,603 | B1 * | 4/2002 | Shimoya | F28F 3/048 165/153 |
| 7,533,717 | B2 * | 5/2009 | Hummel | F28F 9/0075 165/178 |
| 8,662,151 | B2 * | 3/2014 | Gustafsson | F28D 9/005 165/167 |
| 9,694,435 | B2 * | 7/2017 | Sjödin | B23K 35/00 |
| 10,113,814 | B2 | 10/2018 | Persson | |
| 11,280,559 | B2 * | 3/2022 | Onkarachari | F28D 21/0003 |
| 11,346,612 | B2 | 5/2022 | Yin et al. | |
| 12,061,054 | B2 * | 8/2024 | Romlund | F28D 9/005 |
| 12,474,129 | B2 * | 11/2025 | Lee | F24H 3/102 |
| 2008/0078538 | A1 * | 4/2008 | Jalilevand | F28D 1/0333 165/170 |
| 2011/0277974 | A1 * | 11/2011 | Haydock | F28D 9/0031 165/170 |
| 2014/0008046 | A1 * | 1/2014 | Persson | F28F 17/005 165/185 |
| 2014/0158328 | A1 * | 6/2014 | Persson | F28F 9/001 165/109.1 |
| 2015/0233650 | A1 * | 8/2015 | Blomgren | F28F 3/06 165/166 |
| 2017/0184347 | A1 | 6/2017 | Ariyama et al. | |
| 2020/0072556 | A1 | 3/2020 | Ota | |

FOREIGN PATENT DOCUMENTS

| | | | | |
|---|---|---|---|---|
| DE | 102004003790 | A1 * | 8/2005 | F28F 9/0246 |
| DE | 102006022445 | A1 * | 11/2007 | F28F 9/0075 |
| DE | 102018007010 | A1 | 3/2020 | |
| EP | 0867679 | B1 | 9/2003 | |
| SE | 542057 | C2 * | 2/2020 | F28F 3/08 |
| WO | WO-2007004939 | A1 * | 1/2007 | F28F 3/083 |

OTHER PUBLICATIONS

Brazilian Patent Office Search Report Application No. 1020244016325-7 dated Dec. 23, 2025 (11 pages including English machine translation).

* cited by examiner

HEAT EXCHANGER DIMPLE CONFIGURATION

BACKGROUND

The present disclosure relates to heat exchangers. Heat exchangers include a plurality of alternating plates to allow heat exchange between two different fluids. In oil coolers, oil and coolant flow between adjacent plates. In order to enhance the heat exchange between the adjacent plates, the alternating plates often include one or more protrusions and/or turbulator inserts. However, the protrusions and turbulators increase the pressure drop across the heat exchangers, which is undesirable.

SUMMARY

It is an object of the present invention to provide a heat exchanger protrusion configuration that enhances heat exchange while maintaining a low pressure drop relative to other protrusion configurations.

In some embodiments, an oil cooler is connected to a vehicle. The oil cooler includes a flange plate having fastener apertures and fluid flow apertures. The fastener apertures are each sized to receive a fastener to connect the flange plate to the vehicle. The fluid flow apertures permit oil and coolant to flow through the flange plate.

In some embodiments, a base heat exchanger plate having a first surface connected to the flange plate and a second surface spaced away from the flange plate. The base heat exchanger plate includes fluid flow apertures that to permit oil and coolant to flow through the base heat exchanger plate.

In some embodiments, a first heat exchanger plate coupled to the base heat exchanger plate. The first heat exchanger plate has a first perimeter portion and a first central portion. The first perimeter portion surrounds the first central portion and includes a first upwardly extending flange. The first central portion includes a first generally planar surface and a plurality of upstanding impressions extending upwardly from the generally planar surface away from the base heat exchanger plate. An upper distal portion of the upstanding impressions is spaced a first distance from the first generally planar surface. The upper distal portion extends along a first length.

In some embodiments, a second heat exchanger plate is connected to the first heat exchanger plate. The second heat exchanger plate has a second perimeter portion and a second central portion. The second perimeter portion surrounds the second central portion and includes a second upwardly extending flange. The second upwardly extending flange can contact an inner surface of the first upwardly extending flange to thereby connect the second heat exchanger plate to the first heat exchanger plate. The second central portion includes a second generally planar surface and a plurality of descending impressions extending downwardly from the second generally planar surface toward the base heat exchanger plate. A lower distal portion of the descending impressions is spaced a second distance from the second generally planar surface. The second generally planar surface is spaced from the first generally planar surface a third distance while the second heat exchanger plate is connected to the first heat exchanger plate. The lower distal portion extends along a second length.

In some embodiments, a turbulator positioned on an upper surface of the second heat exchanger plate.

In some embodiments, the first distance is less than the third distance and the second distance is less than the third distance.

In some embodiments, a third length of the upper distal portion of one of the upstanding impressions is configured to abut fourth length of the lower distal portion of the corresponding descending impression.

In some embodiments, the third length is less than the first length and the fourth length is less than the second length.

In some embodiments, a third heat exchanger plate is positioned above the turbulator, and a fourth heat exchanger plate is positioned above the third heat exchanger plate. The third heat exchanger plate being substantially identical to the first heat exchanger plate and the fourth heat exchanger plate being substantially identical to the second heat exchanger plate. The oil cooler directs coolant between the first heat exchanger plate and the second heat exchanger plate, and directs oil through the turbulator between the second heat exchanger plate and the third heat exchanger plate.

In some embodiments, the upper distal portion extends along a first width measured perpendicular to the first length, and the lower distal portion extends along a second width measured perpendicular to the second length, the first length being greater than the first width and the second length being greater than the second width.

In some embodiments, the first length is at least twice the first width and the second length is at least twice the second width.

In some embodiments, the first upwardly extending flange is generally rectangular having opposite short sides and opposite long sides. The upstanding impressions extend diagonally with respect to the opposite short sides and with respect to the opposite long sides of the first upwardly extending flange.

In some embodiments, the second upwardly extending flange is generally rectangular having opposite short sides and opposite long sides, and wherein the descending impressions extend diagonally with respect to the opposite short sides and with respect to the opposite long sides of the first upwardly extending flange.

In some embodiments, each upstanding impression extends in a non-parallel direction with respect to the respective descending impression, such that each upstanding impression abuts the respective descending impression along a portion of the first length and a portion of the second length.

In some embodiments, the upstanding impressions extend at an angle of between about 60 to 120 degrees with respect to the descending impressions, such that coolant is permitted to flow over the upstanding impressions and under the descending impressions around the portion of the first length and the portion of the second length that are connected.

In some embodiments, the first distance plus the second distance is substantially equal to the third distance.

In some embodiments, the first distance is substantially equal to the second distance.

In some embodiments, upstanding impressions are elongate and include a tapered perimeter and a flattened upper surface, and wherein the second descending impressions are elongate and include a tapered perimeter and a flattened lower surface.

In some embodiments, a first portion of each of the upstanding impressions is in abutment with a first portion of the respective descending impressions, a second portion of the upstanding impressions is spaced from the respective descending impressions, and a second portion of the descending impressions is spaced from the respective upstanding impressions, such that coolant is permitted to flow over the second portions of the upstanding impressions, and coolant is permitted to flow under the second portions of the descending impressions.

In some embodiments, the first portion of each of the upstanding impressions is generally centrally located along the first length of the respective upstanding impression, and wherein the first portion of each of the descending impressions is generally centrally located along the second length of the respective descending impression.

In some embodiments, the present application is directed to a vehicle including the oil cooler shown and described herein.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
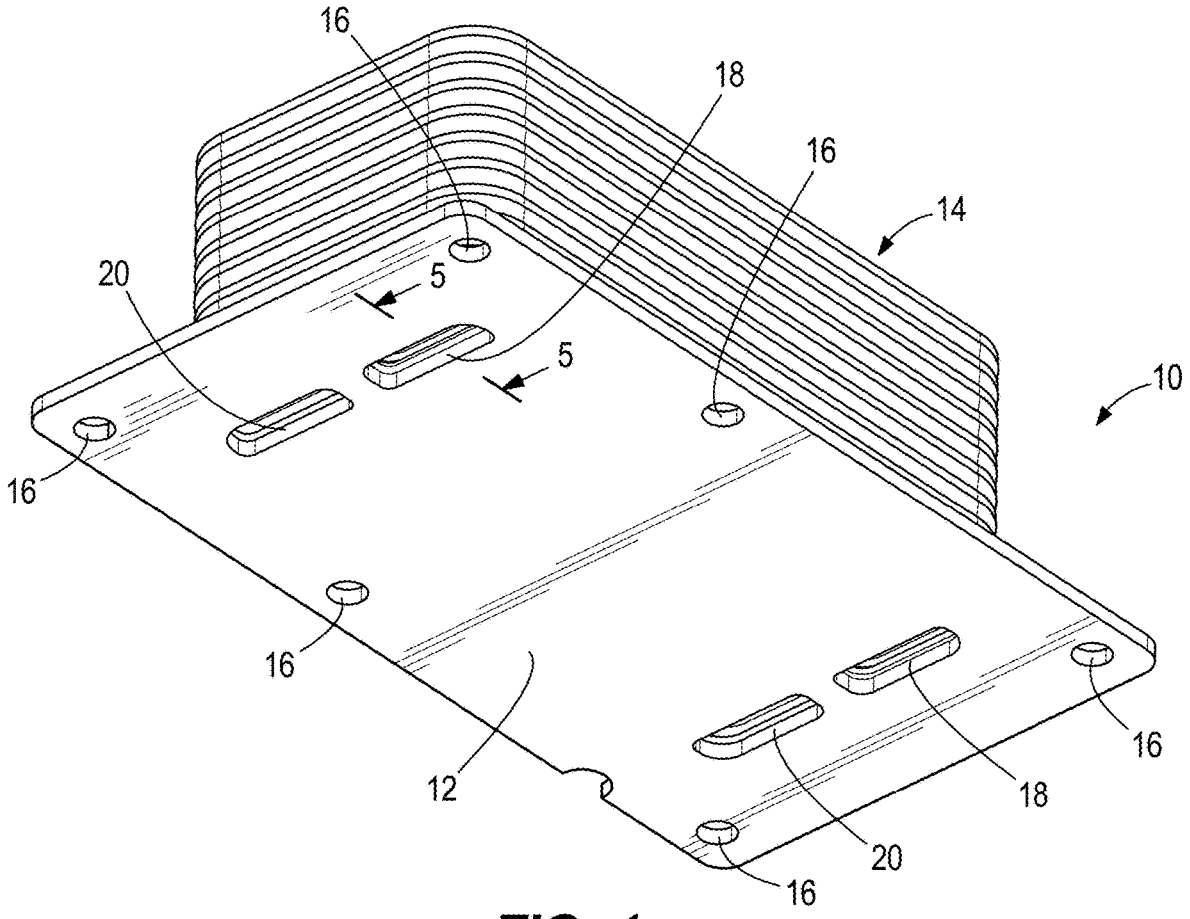
FIG. 1 is a perspective view of an oil cooler according to some embodiments of the present invention.

FIG. 1 illustrates an oil cooler 10 including a flange plate 12 and a stack of heat exchanger plates 14. The flange plate 12 includes a plurality of fastener apertures 16, coolant flow apertures 18 and oil flow apertures 20. The fastener apertures 16 are each configured to receive a fastener to couple the flange plate 12 to a vehicle. The coolant flow apertures 18 are configured to permit coolant to flow through the flange plate 12 and the oil flow apertures 20 that are configured to permit oil to flow through the flange plate 12.

Figure 2:
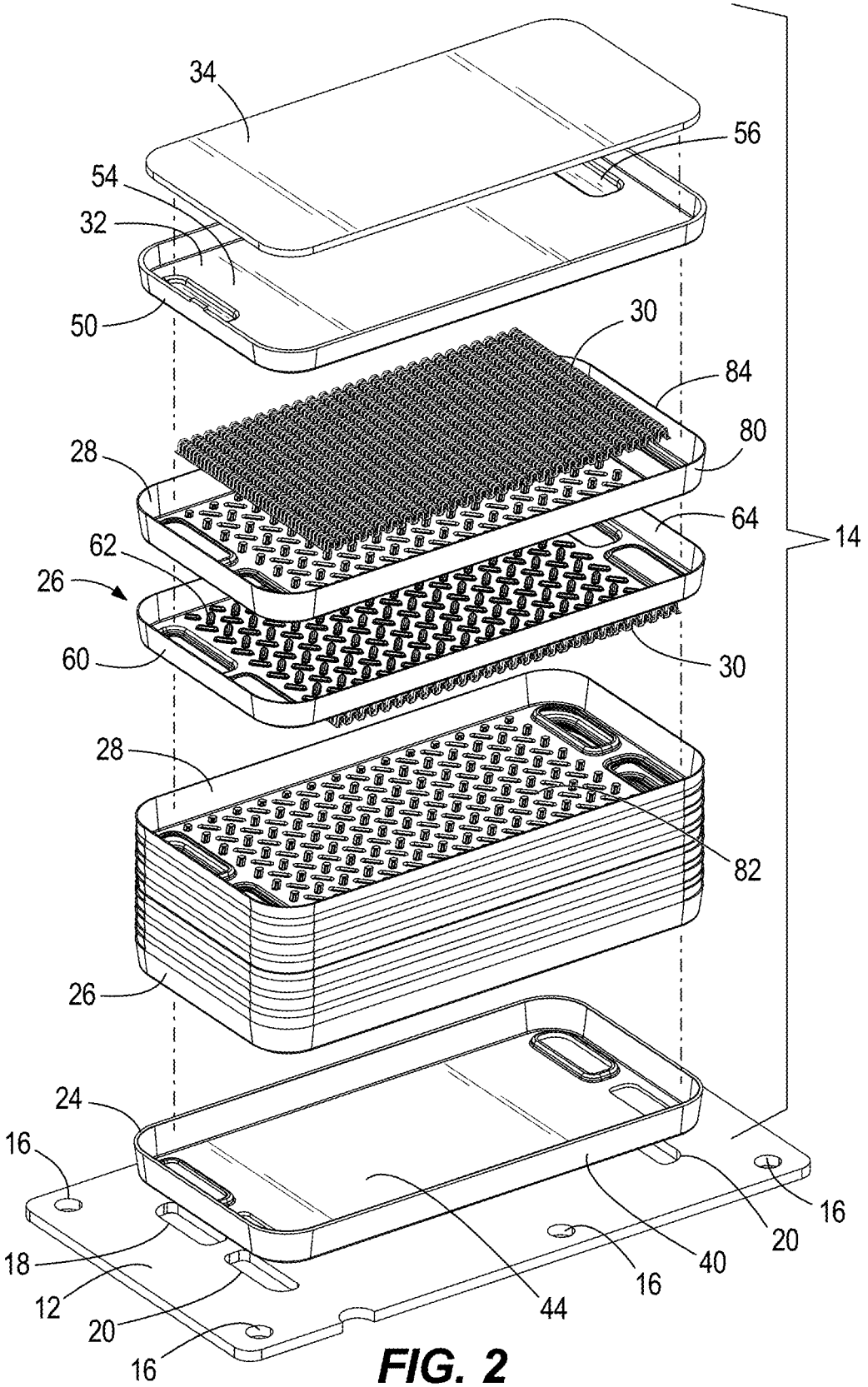
FIG. 2 is a partially exploded view of the oil cooler of FIG. 1.

FIG. 2 illustrates the stack of heat exchanger plates 14 in greater detail. The illustrated stack of heat exchanger plates 14 includes a base heat exchanger plate 24, a plurality of first heat exchanger plates 26, a plurality of second heat exchanger plates 28, a plurality of turbulators 30, an end heat exchanger plate 32 and an end plate 34.

The base heat exchanger plate 24 is generally planar and includes an upwardly extending flange 40 around a perimeter of the base heat exchanger plate 24. The generally planar portion of the base heat exchanger plate 24 includes a first surface configured to be coupled to the flange plate 12 and a second surface 44 spaced away from the flange plate 12. The base heat exchanger plate 24 includes coolant flow apertures that are substantially aligned with the coolant flow apertures 18 while the base heat exchanger plate 24 is coupled to the flange plate 12. Similarly, the base heat exchanger plate 24 includes oil flow apertures that are substantially aligned with the oil flow apertures 20 while the base heat exchanger plate 24 is coupled to the flange plate 12.

One of the plurality of first heat exchanger plates 26 is positioned above and coupled to the base heat exchanger plate 24. In some embodiments, a turbulator is positioned between the base heat exchanger plate 24 and the first heat exchanger plate 26. One of the plurality of second heat exchanger plates 28 is positioned above coupled to the first heat exchanger plate 26 opposite the base heat exchanger plate 24. One of the plurality of turbulators 30 is positioned above the second heat exchanger plate 28 opposite the first heat exchanger plate 26. The first heat exchanger plates 26 alternate with the second heat exchanger plates 28, and a turbulator 30 is positioned above each second heat exchanger plate 28. The first and second heat exchanger plates 26, 28 will be discussed in greater detail below.

The illustrated end heat exchanger plate 32 is positioned on the top of the upper second heat exchanger plate 28 and the upper turbulator 30. The end heat exchanger plate 32 includes a generally planar portion and includes an upwardly extending flange 50 around a perimeter of the end heat exchanger plate 32. The generally planar portion of the end heat exchanger plate 32 includes a first surface configured to contact the upper turbulator 30 and a second surface 54 spaced away from the upper turbulator 30. The illustrated end heat exchanger plate 32 includes depressions 56 positioned above the coolant flow apertures 18.

The illustrated end plate 34 is generally planar and is configured to be coupled to second surface of the end heat exchanger plate 32. The end plate 34 is configured to increase the rigidity of the oil cooler 10. In some embodiments, the end plate 34 is omitted.

The illustrated flange plate 12, base heat exchanger plate 24, end heat exchanger plate 32 and end plate 34 are provided as one possible configuration. Other configurations of flange plates, base heat exchanger plates, end heat exchanger plates and end plates are possible and are considered to be within the scope of the present disclosure.

Figure 3:
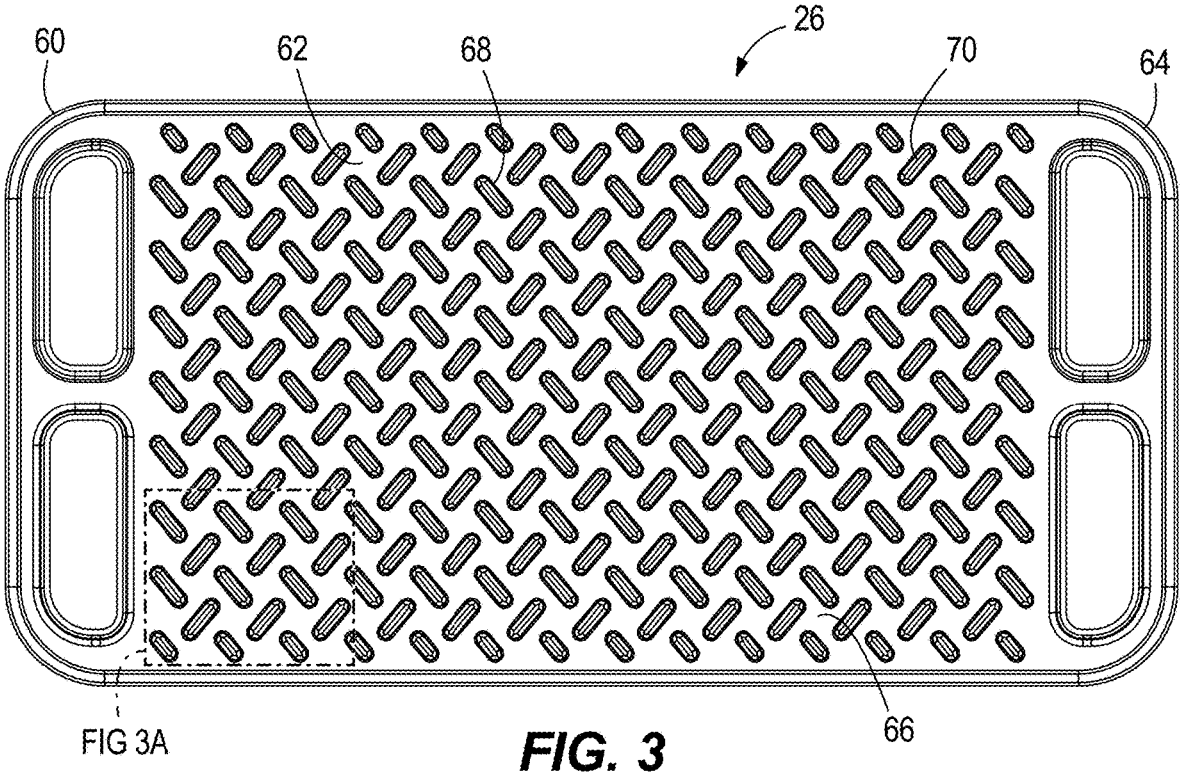
FIG. 3 is a top view of a first heat exchanger plate.

FIG. 3 illustrates one first heat exchanger plate 26 in greater detail. Each first heat exchanger plate 26 is substantially identical, so only one first heat exchanger plate 26 will be described in detail herein. The first heat exchanger plate 26 has a first perimeter portion 60 and a first central portion 62. The first perimeter portion 60 surrounds the first central portion 62 and includes a first upwardly extending flange 64 (see FIG. 2).

The first central portion 62 includes a first generally planar surface 66 and a plurality of upstanding impressions 68, 70 that extend upwardly from the generally planar surface away from the base heat exchanger plate 24. The first upwardly extending flange 64 is generally rectangular and has opposite short sides and opposite long sides. All of the upstanding impressions 68, 70 extend diagonally with respect to the opposite short sides and with respect to the opposite long sides of the first upwardly extending flange 64.

Figure 3A:
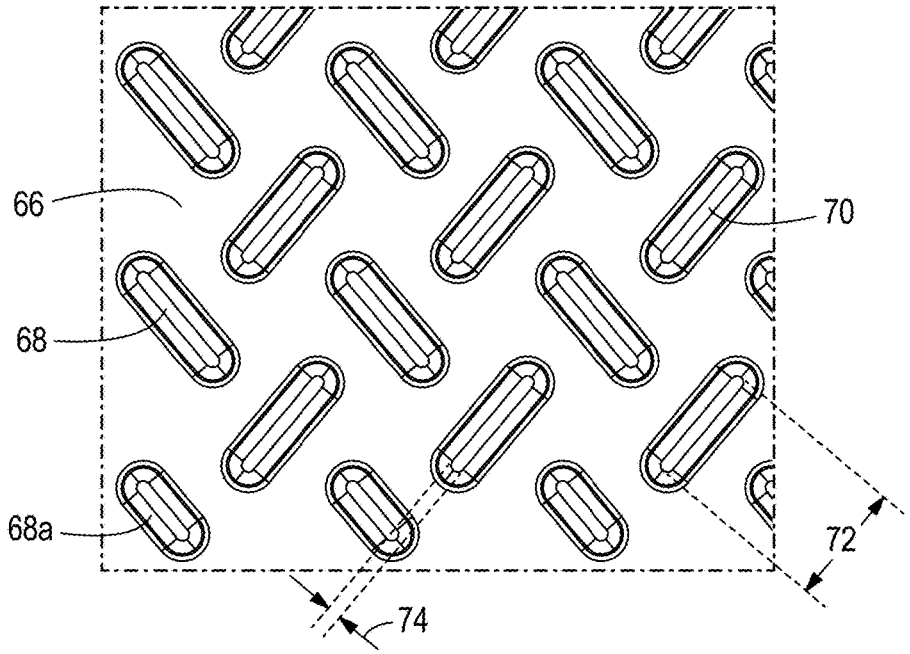
FIG. 3A is a close-up view of a portion of the first heat exchanger plate of FIG. 3.

FIG. 3A illustrates the upstanding impressions 68, 70 in greater detail. The illustrated upstanding impressions 68, 70 are similarly shaped and sized, but the upstanding impressions 68 are oriented at a non-parallel angle with respect to the upstanding impressions 70. In the illustrated embodiment, the angle between the upstanding impressions 68 and 70 is approximately an 80-degree angle. Other angles or ranges of angles can be utilized in other embodiments. Applicants have found that angles within the range of 60 to 120 degrees to be most beneficial for improved heat exchanger performance.

The upstanding impressions 68, 70 are elongate and have an upper distal portion having a first length 72 measured parallel to the first generally planar surface 66, and a first width 74 measured perpendicular to the first length 72. The first length 72 is longer than the first width 74. In the illustrated embodiment, the first length 72 is more than twice the first width 74.

Optionally, upstanding impressions 68*a* are included near the long sides of the first upwardly extending flange 64. These optional upstanding impressions 68*a* have a shorter length than the remaining upstanding impressions 68, 70. The optional upstanding impressions 68*a* are spaced inward from the first upwardly extending flange 64 and can be adjusted in size to accommodate different size requirements of the overall oil cooler 10. The illustrated optional upstanding impressions 68*a* are parallel to the upstanding impressions 68. In some embodiments, some of the optional upstanding impressions are oriented parallel to the upstanding impressions 70.

Figure 4:
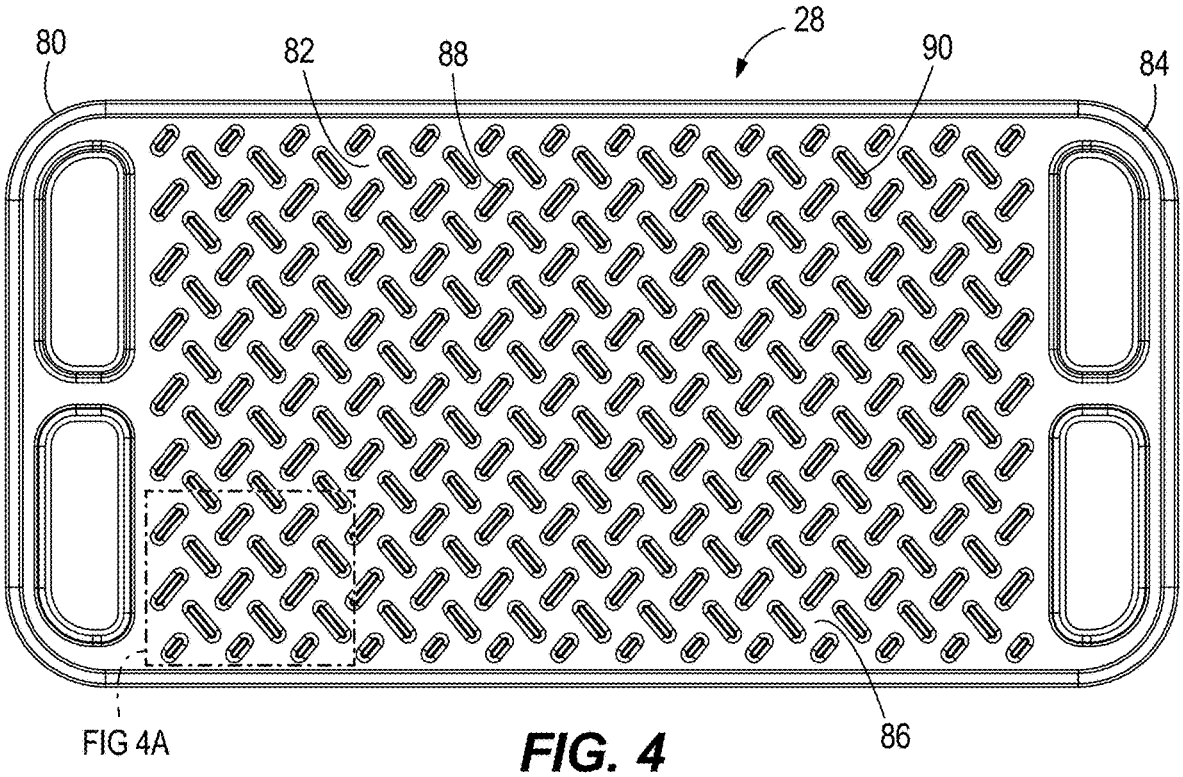
FIG. 4 is a top view of a second heat exchanger plate.

FIG. 4 illustrates the second heat exchanger plate 28 in greater detail. Each second heat exchanger plate 28 is substantially identical, so only one second heat exchanger plate 28 will be described in detail herein. The second heat exchanger plate 28 has a second perimeter portion 80 and a second central portion 82. The second perimeter portion 80 surrounds the second central portion 82 and includes a second upwardly extending flange 84 (see FIG. 2). An outer surface of the second upwardly extending flange 84 is configured to contact an inner surface of the first upwardly extending flange 64 to thereby couple the second heat exchanger plate 28 to the first heat exchanger plate 26.

The second central portion 82 includes a second generally planar surface 86 and a plurality of descending impressions 88, 90 extending downwardly from the second generally planar surface 86 toward the base heat exchanger plate 24.

The second upwardly extending flange 84 is generally rectangular and has opposite short sides and opposite long sides. All of the descending impressions 88, 90 extend diagonally with respect to the opposite short sides and with respect to the opposite long sides of the second upwardly extending flange 84.

Figure 4A:
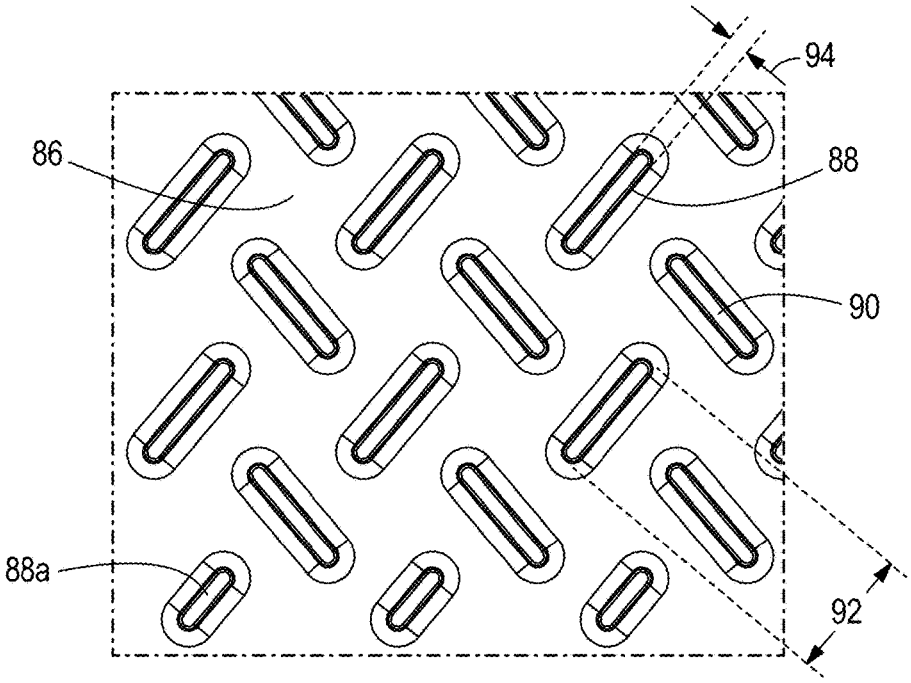
FIG. 4A is a close up view of a portion of the second heat exchanger plate of FIG. 4.

FIG. 4A illustrates the descending impressions 88, 90 in greater detail. The illustrated descending impressions 88, 90 are similarly shaped and sized, but the descending impressions 88 are oriented at a non-parallel angle with respect to the descending impressions 90. In the illustrated embodiment, the angle between the descending impressions 88 and 90 is approximately an 80-degree angle. Other angles or ranges of angles can be utilized in other embodiments. Applicants have found that angles within the range of 60 to 120 degrees to be most beneficial for improved heat exchanger performance.

The descending impressions 88, 90 are elongate and have a lower distal portion having a second length 92 measured parallel to the second generally planar surface 86, and a second width 94 measured perpendicular to the second length 92. While the upper face of the second heat exchanger plate 28 is illustrated, it is to be understood that the second length 92 and second width 94 are measured on the lower surface of the second heat exchanger plate. The second length 92 is longer than the second width 94. In the illustrated embodiment, the second length 92 is more than twice the second width 94.

Optionally, descending impressions 88*a* are included near the long sides of the second upwardly extending flange 84. These optional descending impressions 88*a* have a shorter length than the remaining descending impressions 88, 90. The optional descending impressions 88*a* are spaced inwardly from the second upwardly extending flange 84 and can be adjusted in size to accommodate different size requirements of the overall oil cooler 10. The illustrated optional upstanding impressions 88*a* are parallel to the upstanding impressions 88. In some embodiments, some of the optional upstanding impressions are oriented parallel to the upstanding impressions 90.

Figure 5:
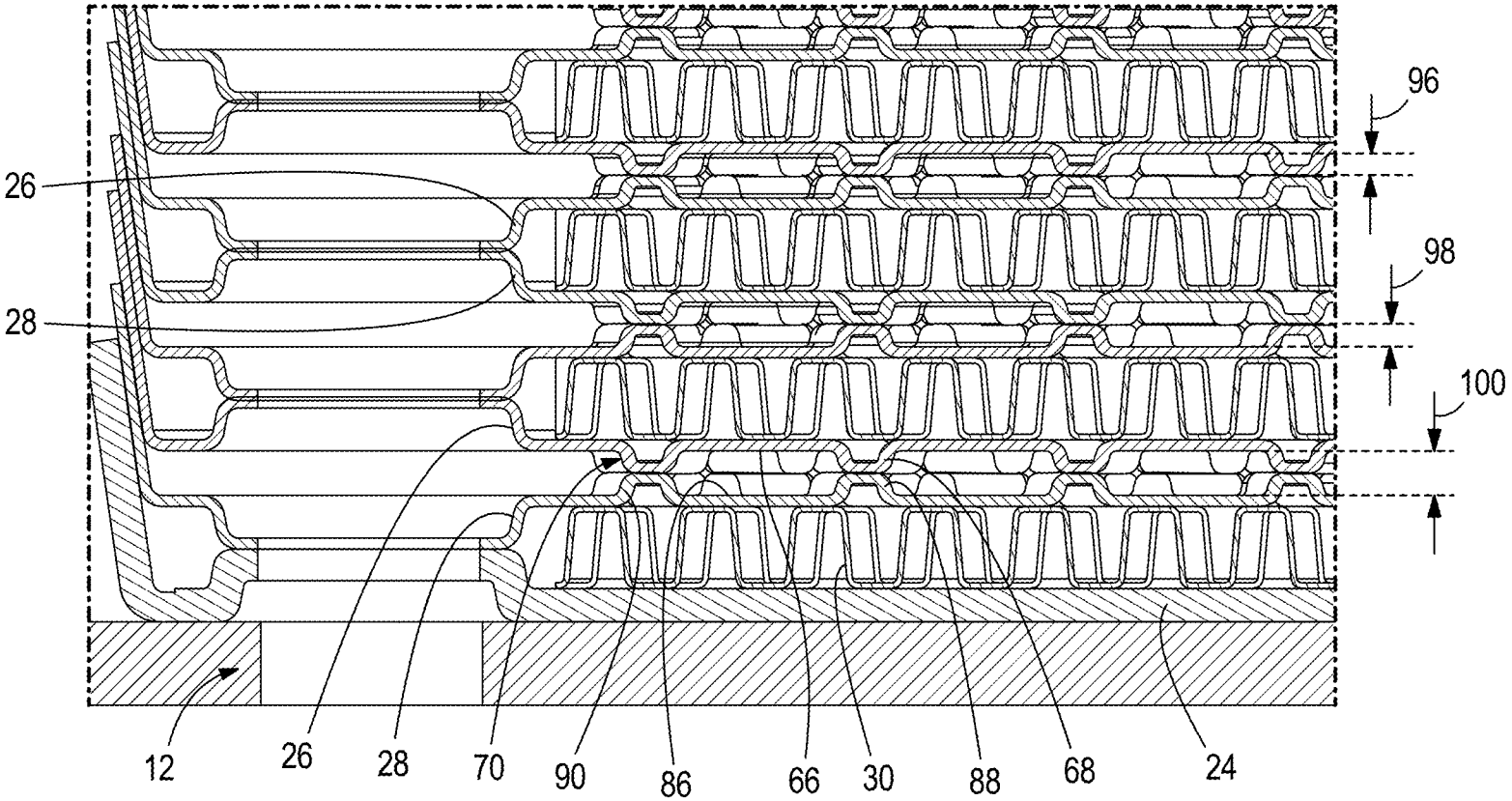
FIG. 5 is a cross-sectional view taken along line 5-5 of FIG. 1.
Figure 6:
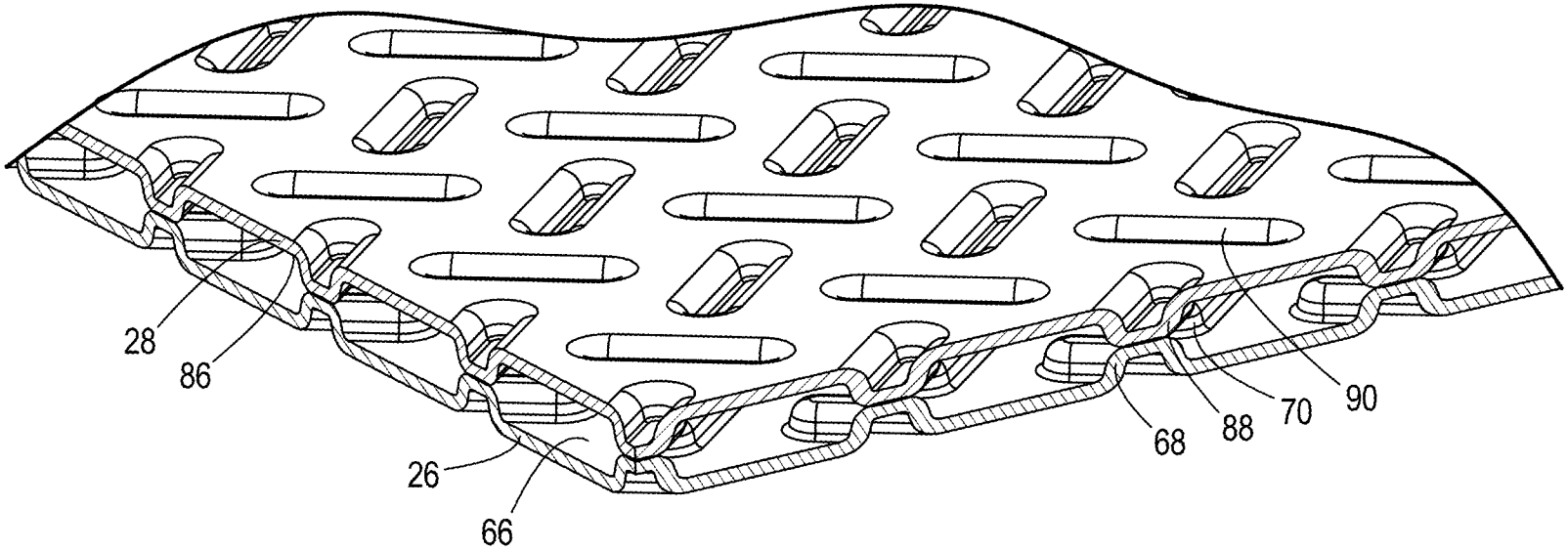
FIG. 6 is a close-up cross-sectional view of two adjacent heat exchanger plates.

As shown in FIGS. 5 and 6, the perimeter of the upstanding impressions 68, 70 is tapered between the generally planar surface 66 and the upper distal portion. The perimeter of the descending impressions 88, 90 is tapered between the generally planar surface 86 and the lower distal portion.

The upper distal portion of the upstanding impressions 68, 70 is a flattened upper surface. The lower distal portion of the descending impressions 88, 90 is a flattened lower surface. A portion of the flattened upper surface abuts against a portion of the flattened lower surface. The upper distal portion of each upstanding impression 68, 70 is spaced a first distance 96 above the first generally planar surface 66. The lower distal portion of each descending impression 88, 90 is spaced a second distance 98 from the second generally planar surface 86.

While the first heat exchanger plate 26 is joined to the second heat exchanger plate 28, the first generally planar surface 66 of the first heat exchanger plate 26 is spaced a third distance 100 from the second generally planar surface 86 of the second heat exchanger plate 28. The first distance 96 is less than the third distance 100 and the second distance 98 is less than the third distance 100.

The first distance 96 plus the second distance 98 is substantially equal to the third distance 100 to permit the abutting portions of the first and second heat exchanger plates 26, 28 to be connected (e.g., by brazing or other suitable joining technique). In the illustrated embodiment, the first distance 96 is approximately equal to the second distance 98. In other embodiments, the first distance 96 is different than the second distance 98.

Each of the upstanding impressions 68 is positioned to abut a respective one of the descending impressions 88, and each of the upstanding impressions 70 is positioned to abut a respective one of the descending impressions 90 when the first heat exchanger plate 26 is joined to the second heat exchanger plate 28. The coolant is configured to flow over the upstanding impressions 68, 70 and under the descending impressions 88, 90 and the oil is configured to flow across the turbulator 30. The contact between adjacent impressions 68, 88 and 70, 90 enhances the heat exchange between coolant and oil, as well as maintaining consistent spacing between adjacent first and second plates 26, 28. In some embodiments, the abutting impressions are brazed to further increase the strength of the oil cooler 10.

As shown in FIG. 6, the upstanding impressions 68, 70 extend in a non-parallel direction with respect to the respective descending impressions 88, 90. In the illustrated embodiment, the upstanding impressions 68, 70 intersect the respective descending impressions 88, 90 at approximately an 80-degree angle. However, other angles, such as angles between 60 and 120 degrees are suitable. Since the upstanding impressions 68, 70 and the descending impressions 88, 90 are elongate, only a portion of each upstanding impression 68, 70 abuts a portion of the respective descending impression 88, 90.

Figure 7:
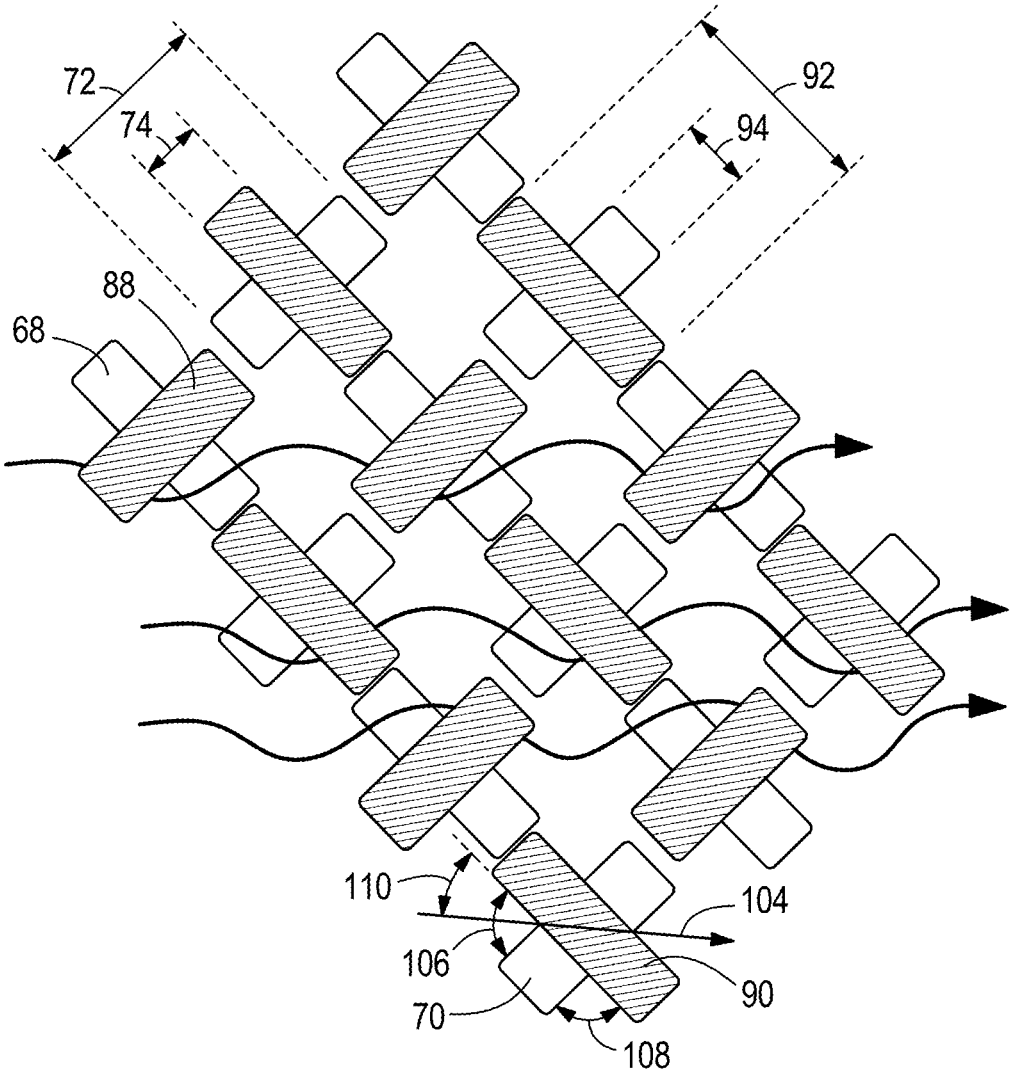
FIG. 7 is a schematic view showing the flow path between the heat exchanger plates of FIG. 6.

With reference to FIG. 7, the upper surface of the upper distal portions of the upstanding impressions 68, 70 and the lower surface of the lower distal portions of the descending impressions 88, 90 are illustrated schematically. The upper surface of the upper distal portion of each of the upstanding impressions 68, 70 extends the first length 72 and the first width 74. The lower surface of the lower distal portion of each of the illustrated descending impressions 88, 90 extends the second length 92 and the second width 94. Only a portion of the upper surface of the upper distal portion of each upstanding impression 68, 70 abuts a portion of the lower surface of the lower distal portion of the respective descending impression 88, 90. Since the illustrated upper distal portions of the upstanding impressions 68, 70 extend generally perpendicular to the lower distal portions of the descending impressions 88, 90, the portion of the upper distal portion of each upstanding impression 68, 70 that abuts the lower distal portion of the respective descending impression 88, 90 has a length substantially equal to the width of the lower distal portion of the respective descending impression 88, 90. Likewise, in the illustrated embodiment, the portion of the lower distal portion of each descending impression 88, 90 that abuts the upper distal portion of the respective upstanding impression 68, 70 has a length substantially equal to the width of the respective upstanding impression 68, 70.

FIG. 7 shows an angle of about 90 degrees between the upstanding impressions 68, 70 and the descending impressions 88, 90. The upstanding impressions 68, 70 can be oriented at an angle between about 60 and 120 degrees with respect to the descending impressions 88, 90 while still maintaining desirable performance metrics. In embodiments with a non-perpendicular angle between the upstanding impressions 68, 70 and the descending impressions 88, 90, the abutment length will be greater than the width 74, 94 of the upper or lower distal portion of the opposing impression. However, the abutment length of the upper distal portion of the upstanding impressions 68, 70 and the lower distal portion of the respective descending impressions 88, 90 will always be less than the overall length 72 of the upper distal portion of the respective upstanding impressions 68, 70 and less than the overall length 92 of the lower distal portion of the descending impressions 88, 90.

The fluid flow direction is shown by arrow 104. A first angle 106 is measured between the upstanding impression 70 and the descending impression 90. A second angle 108 is the supplementary angle of the first angle 106. A third angle 110 is measured between the descending impression 90 and the fluid flow direction 104. The third angle 110 is half of the first angle 106. The third angle 110 is between about 30 and 60 degrees.

The remaining portion of the upper distal portion of the upstanding impressions 68, 70 that is not in abutment with the lower distal portion of the respective descending impression 88, 90 is spaced from the remaining portion of the lower distal portion of the respective descending impression, 88, 90 to permit coolant to flow over portions of the upper distal portions of the upstanding impressions 68, 70. This coolant flow is represented by arrows in FIG. 7. The remaining portion of the lower distal portion of the descending impressions 88, 90 that is not in abutment with the upper distal portion of the respective upstanding impression 68, 70 is spaced from the remaining portion of the upper distal portion of the respective upstanding impression, 68, 70 to permit coolant to flow under portions of the upper distal portions of the descending impressions 88, 90.

The illustrated upstanding impressions 68, 70 are generally centered over the respective descending impressions 88, 90. The central portions of the upstanding impression 68, 70 abut the central portions of the descending impressions 88, 90. In other, non-illustrated embodiments, the upstanding impressions 68, 70 are somewhat offset from the respective descending impressions 88, 90. In some of these embodiments, a non-central portion of the upstanding impressions 68, 70 abuts a central portion of the descending impression 88, 90. In some of these embodiments, a central portion of the upstanding impressions 68, 70 abuts a non-central portion of the descending impression 88, 90. In some of these embodiments, a non-central portion of the upstanding impressions 68, 70 abuts a non-central portion of the descending impression 88, 90.

Figure 8:
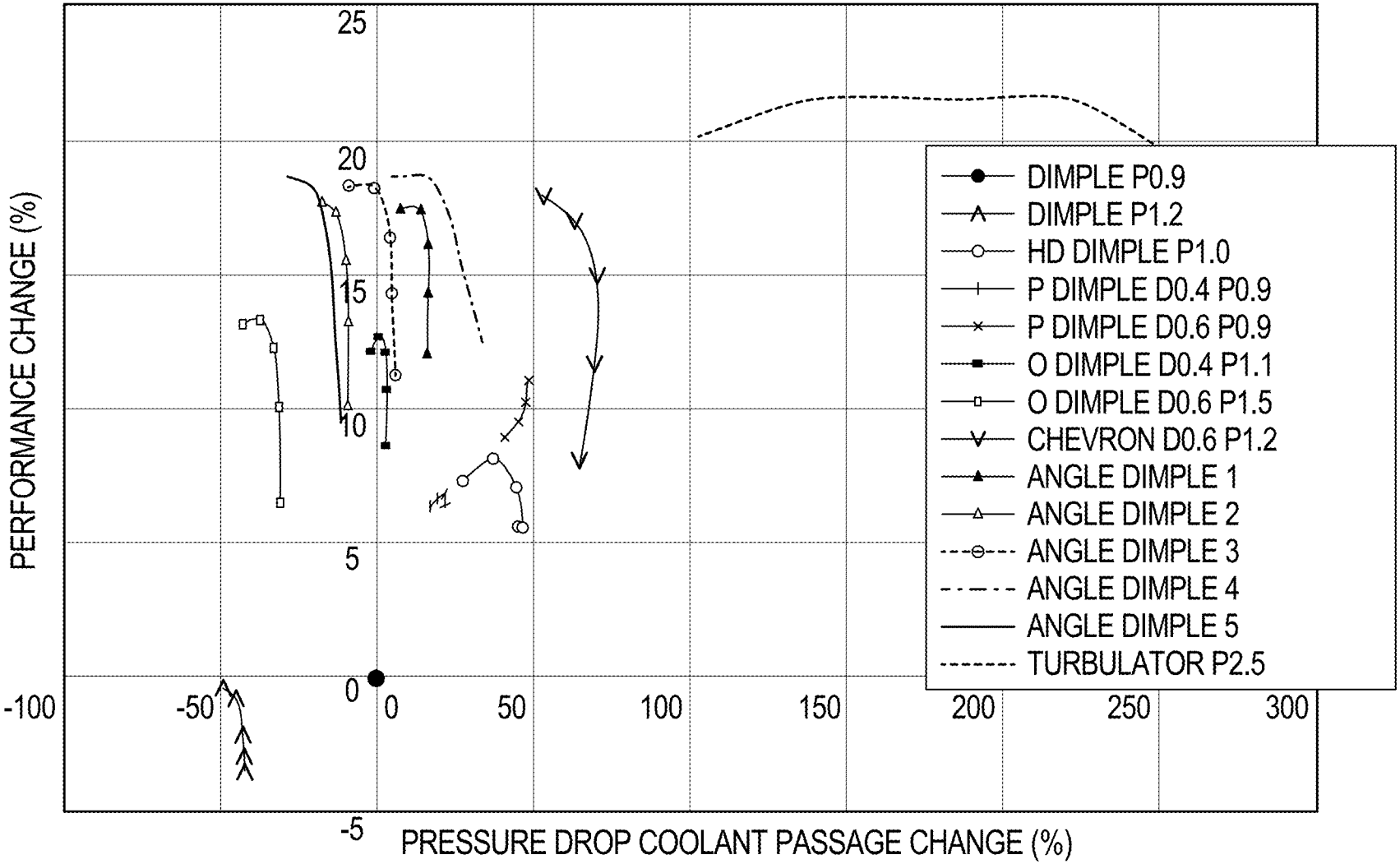
FIG. 8 is a graph comparing the pressure drop and heat exchanger performance of the present configuration in comparison to a standard dimple configuration.

FIG. 8 illustrates the simulation results of several different types of heat exchanger configurations. A standard dimple configuration (DIMPLE) having a passage height of 0.9 mm is used as the control. The remaining configurations are compared to the standard dimple configuration for both the pressure drop change across the coolant passage (X axis) and for the heat exchanger performance change (Y axis). The legend indicates the dimple height as D, and the passage height as P.

The HD DIMPLE configuration is sold by a competitor and includes high density dimples. The P DIMPLE configurations are disclosed in DE 10 2018 007 010 A1. The O DIMPLE configurations include the dimples from DE 10 2018 007 010 A1 on both sets of tube sheets. The chevron design is shown in FIGS. 9-11 and is discussed in more detail below.

The ANGLE DIMPLE configurations are newly disclosed herein. Different geometric values, such as the third angle 110, the height of the impressions and the fluid passage height were varied to obtain five different simulation results. Each of these results outperformed the prior art configurations, as shown in FIG. 8. The ANGLE DIMPLE configurations, such as the configuration described above, demonstrated an improvement in heat exchanger performance while maintaining an acceptable pressure drop across the coolant passage. Some of the configurations had a decreased pressure drop along with an improved heat exchanger performance as shown in FIG. 8. As noted in the background, it is desirable to maintain a relatively low pressure drop across the heat exchanger without compromising heat exchanger performance. The present configuration achieves the desired result of improved heat exchanger performance and decreased pressure drop across the coolant passage.

The TURBULATOR configuration shows a configuration in which a turbulator is included between each of the heat exchanger plates, both in the coolant passageways and the oil passageways.

Figure 9:
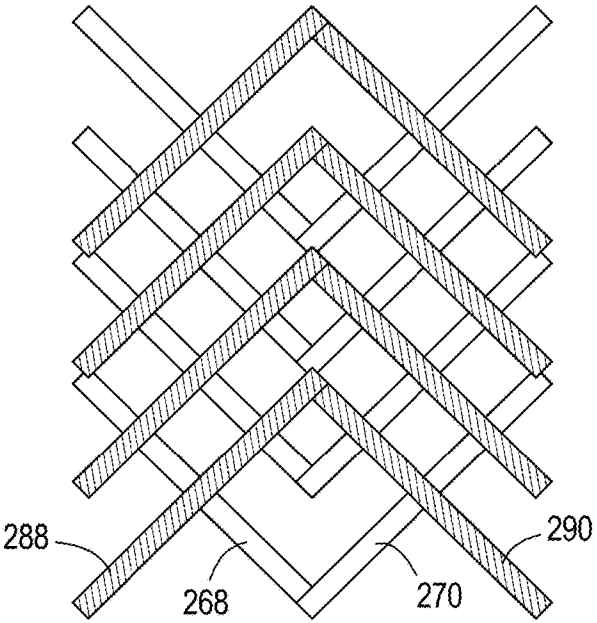
FIG. 9 shows a schematic view of one possible alternate embodiment.
Figure 11:
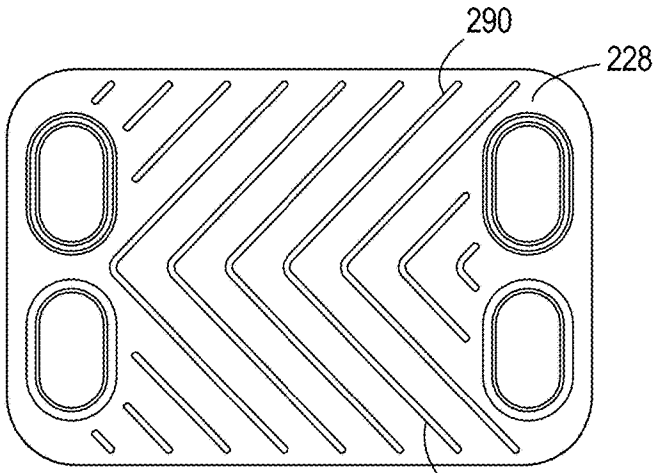
FIG. 11 is a top view of the second plate according to the embodiment of FIG. 9.
Figure 10:
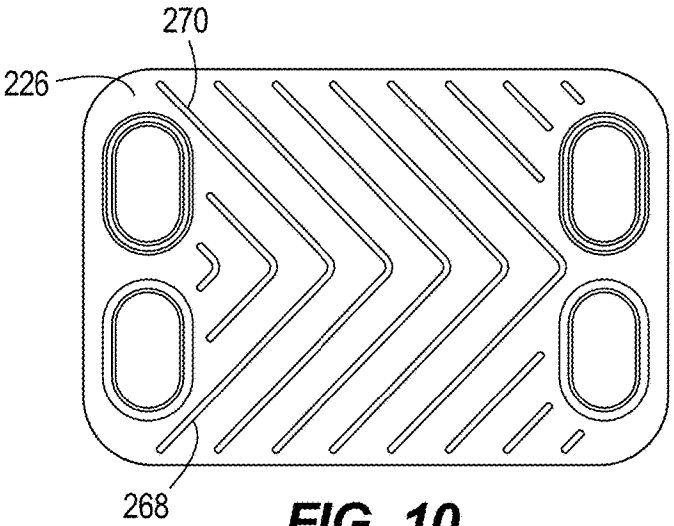
FIG. 10 is a top view of the first plate according to the embodiment of FIG. 9.

FIGS. 9-11 illustrate an alternative embodiment that includes upstanding impressions 268, 270 that extend on opposite halves of the first heat exchanger plate 226 in a chevron shape. The data for this design is included in the FIG. 8 graph as CHEVRON. Essentially, upstanding impressions 268 extend diagonally with respect to the first heat exchanger plate 226 and intersect upstanding impressions 270 at approximately a 90-degree angle in the middle of the first heat exchanger plate 226. Similarly descending impressions 288, 290 extend on opposite halves of the second heat exchanger plate 228 in a chevron shape. Descending impressions 288 extend diagonally with respect to the second heat exchanger plate 228 and intersect descending impressions 290 at approximately a 90-degree angle in the middle of the second heat exchanger plate 228. As shown schematically in FIG. 9, each upstanding impression 268, 270 abuts portions of several descending impressions 288, 290. Likewise, each descending impression 288, 290 abuts portions of several upstanding impressions 268, 270. Each abutment is connected (e.g., joined, brazed etc.) and coolant is permitted to flow over the upstanding impressions 268, 270 and under the descending impressions 288, 290 around each abutment.

In other embodiments, the configuration of FIGS. 9-11 orients the upstanding impressions 268 at an angle between 60 and 120 degrees with respect to the upstanding impressions 270. Similarly, such embodiments can orient the descending impression 288 at an angle between 60 and 120 degrees with respect to the descending impression 290.

The present application presents different embodiments of heat exchanger protrusion configurations that enhance heat exchanger performance while maintaining a low pressure drop relative to other protrusion configurations.

What is claimed is:

1. An oil cooler configured to be coupled to a vehicle, the oil cooler comprising:

a flange plate including fastener apertures and fluid flow apertures, the fastener apertures each configured to receive a fastener to couple the flange plate to the vehicle, the fluid flow apertures configured to permit oil and coolant to flow through the flange plate;

a base heat exchanger plate having a first surface coupled to the flange plate and a second surface spaced away from the flange plate, the base heat exchanger plate including fluid flow apertures extending therethrough to permit oil and coolant to flow through the base heat exchanger plate;

a first heat exchanger plate coupled to the base heat exchanger plate, the first heat exchanger plate having a first perimeter portion and a first central portion, the first perimeter portion surrounding the first central portion and including a first upwardly extending flange, the first central portion including a first substantially planar surface a first plurality of upstanding impressions and extending upwardly from the first substantially planar surface away from the base heat exchanger plate, and a second plurality of upstanding impressions extending upwardly from the first substantially planar surface away from the base heat exchanger plate, a first upper distal portion of the first plurality of upstanding impressions spaced a first distance from the first substantially planar surface, the first upper distal portion extending along a first length, a second upper distal portion of the second plurality of upstanding impressions spaced the first distance from the first substantially planar surface, the second upper distal portion extending along the first length;

a second heat exchanger plate coupled to the first heat exchanger plate, the second heat exchanger plate having a second perimeter portion and a second central portion, the second perimeter portion surrounding the second central portion and including a second upwardly extending flange, the second upwardly extending flange configured to contact an inner surface of the first upwardly extending flange to thereby couple the second heat exchanger plate to the first heat exchanger plate, the second central portion including a second substantially planar surface, a first plurality of descending impressions extending downwardly from the second substantially planar surface toward the base heat exchanger plate, a first lower distal portion of each of the first plurality of descending impressions spaced a second distance from the second substantially planar surface, the second substantially planar surface spaced from the first substantially planar surface a third distance while the second heat exchanger plate is coupled to the first heat exchanger plate, the first lower distal portion extending along a second length, and a second plurality of descending impressions extending downwardly from the second substantially planar surface toward the base heat exchanger plate, a second lower distal portion of each of the second plurality of descending impressions spaced the second distance from the second substantially planar surface, the second lower distal portion extending along the second length; and a turbulator positioned on an upper surface of the second heat exchanger plate, wherein the first distance is less than the third distance and the second distance is less than the third distance, wherein a third length of the first upper distal portion of one of the first plurality of upstanding impressions is configured to abut a fourth length of the first lower distal portion of a corresponding one of the first plurality of descending impressions, and wherein the third length is less than the first length and the fourth length is less than the second length, wherein the first plurality of upstanding impressions are oriented at a non-parallel angle with respect to the second plurality of upstanding impressions, and wherein the angle between the first plurality of upstanding impressions and the second plurality of upstanding impressions is within the range of 60 to 120 degrees.

2. The oil cooler of claim 1, further comprising a third heat exchanger plate positioned above the turbulator, and a fourth heat exchanger plate positioned above the third heat exchanger plate, the third heat exchanger plate being substantially identical to the first heat exchanger plate and the fourth heat exchanger plate being substantially identical to the second heat exchanger plate, wherein the oil cooler is configured to direct coolant between the first heat exchanger plate and the second heat exchanger plate, and is configured to direct oil through the turbulator between the second heat exchanger plate and the third heat exchanger plate.

3. The oil cooler of claim 2, wherein the first upper distal portion extends along a first width measured perpendicular to the first length, and the first lower distal portion extends along a second width measured perpendicular to the second length, the first length being greater than the first width and the second length being greater than the second width.

4. The oil cooler of claim 3, wherein the first length is at least twice the first width and wherein the second length is at least twice the second width.

5. The oil cooler of claim 4, wherein the first upwardly extending flange is substantially rectangular having opposite short sides and opposite long sides.

6. The oil cooler of claim 5, wherein the second upwardly extending flange is substantially rectangular having opposite short sides and opposite long sides, and wherein the first plurality of descending impressions extend diagonally with respect to the opposite short sides and with respect to the opposite long sides of the first upwardly extending flange.

7. The oil cooler of claim 1, wherein each of the first plurality of upstanding impressions abuts the respective one of the first plurality of descending impressions along a portion of the first length and a portion of the second length, such that coolant is permitted to flow over the first plurality of upstanding impressions and under the plurality of descending impressions around the portion of the first length and the portion of the second length that are connected.

8. The oil cooler of claim 1, wherein the first distance plus the second distance is substantially equal to the third distance.

9. The oil cooler of claim 8, wherein the first distance is substantially equal to the second distance.

10. The oil cooler of claim 1, wherein the first plurality of upstanding impressions and the second plurality of upstanding impressions are elongate and include a tapered perimeter and a flattened upper surface, and wherein the first plurality of descending impressions and the second plurality of descending impressions are elongate and include a tapered perimeter and a flattened lower surface.

11. The oil cooler of claim 10, wherein a first portion of each of the first plurality of upstanding impressions is in abutment with a first portion of the respective one of the first plurality of descending impressions, a second portion of the first plurality of upstanding impressions is spaced from the respective one of the first plurality of descending impressions, and a second portion of the one of the first plurality of descending impressions is spaced from the respective one of the first plurality of upstanding impressions, such that coolant is permitted to flow over the second portions of the first plurality of upstanding impressions, and coolant is permitted to flow under the second portions of the first plurality of descending impressions.

12. The oil cooler of claim 11, wherein the first portion of each of the first plurality of upstanding impressions is substantially centrally located along the first length of the respective upstanding impression, and wherein the first portion of each of the first plurality of descending impressions is substantially centrally located along the second length of the respective descending impression.

13. The oil cooler of claim 1, wherein the first upper distal portion extends along a first width measured perpendicular to the first length, and the first lower distal portion extends along a second width measured perpendicular to the second length, the first length being greater than the first width and the second length being greater than the second width.

14. The oil cooler of claim 13, wherein the first length is at least twice the first width and wherein the second length is at least twice the second width.

15. The oil cooler of claim 1, wherein the first upwardly extending flange is substantially rectangular having opposite short sides and opposite long sides.

16. The oil cooler of claim 1, wherein the second upwardly extending flange is substantially rectangular having opposite short sides and opposite long sides, and wherein the first plurality of descending impressions extend diagonally with respect to the opposite short sides and with respect to the opposite long sides of the first upwardly extending flange.

17. The oil cooler of claim 1, wherein each of the first plurality of upstanding impressions abuts the respective one of the plurality of descending impressions along a portion of the first length and a portion of the second length, such that coolant is permitted to flow over the first plurality of upstanding impressions and under the first plurality of descending impressions around the portion of the first length and the portion of the second length that are connected.

18. The oil cooler of claim 1, wherein the first distance plus the second distance is substantially equal to the third distance, and wherein the first distance is substantially equal to the second distance.

19. The oil cooler of claim 1, wherein a first portion of each of the first plurality of upstanding impressions is in abutment with a first portion of the respective one of the plurality of descending impressions, a second portion of each of the first plurality of upstanding impressions is spaced from the respective one of the first plurality of descending impressions, and a second portion of each of the plurality of descending impressions is spaced from the respective one of the plurality of upstanding impressions, such that coolant is permitted to flow over the second portions of the plurality of upstanding impressions, and coolant is permitted to flow under the second portions of the plurality of descending impressions.

20. The oil cooler of claim 19, wherein the first portion of each of the first plurality of upstanding impressions is substantially centrally located along the first length of the respective one of the first plurality of upstanding impressions, and wherein the first portion of each of the plurality of descending impressions is substantially centrally located along the second length of the respective one of the plurality of descending impressions.

* * * * *